US009890944B2

(12) United States Patent
Chou

(10) Patent No.: US 9,890,944 B2
(45) Date of Patent: Feb. 13, 2018

(54) RECESSED LIGHT FIXTURE

(71) Applicant: LEXTAR ELECTRONICS CORPORATION, Hsinchu (TW)

(72) Inventor: Shih-Chin Chou, Kaohsiung (TW)

(73) Assignee: Lextar Electronics Corporation, Hsinchu (TW)

( * ) Notice: Subject to any disclaimer, the term of this patent is extended or adjusted under 35 U.S.C. 154(b) by 306 days.

(21) Appl. No.: 14/705,904

(22) Filed: May 6, 2015

(65) Prior Publication Data

US 2015/0354805 A1 Dec. 10, 2015

Related U.S. Application Data

(60) Provisional application No. 62/009,393, filed on Jun. 9, 2014.

(51) Int. Cl.

| | |
|---|---|
| ***F21S 8/00*** | (2006.01) |
| ***F21V 29/87*** | (2015.01) |
| ***F21S 8/02*** | (2006.01) |
| ***F21V 21/04*** | (2006.01) |
| ***F21V 25/12*** | (2006.01) |
| *F21W 131/40* | (2006.01) |

(52) U.S. Cl.

CPC ..... *F21V 29/87* (2015.01); *F21S 8/026* (2013.01); *F21V 21/047* (2013.01); *F21V 25/125* (2013.01); *F21W 2131/40* (2013.01)

(58) Field of Classification Search

CPC ..... F21S 8/02; F21S 8/026; F21V 21/047; F21V 25/12; F21V 25/125; F21V 29/87; F21W 2101/00

See application file for complete search history.

(56) References Cited

U.S. PATENT DOCUMENTS

| | | | | |
|---|---|---|---|---|
| 2007/0175649 | A1* | 8/2007 | Moselle | H02G 3/088 174/50 |
| 2007/0206374 | A1* | 9/2007 | Petrakis | F21V 25/00 362/147 |
| 2008/0170404 | A1* | 7/2008 | Steer | F21S 8/02 362/365 |

FOREIGN PATENT DOCUMENTS

| | | |
|---|---|---|
| EP | 2778509 | 9/2014 |
| GB | 2422191 | 7/2006 |
| GB | 2421070 | 1/2007 |
| GB | 2505337 | 2/2014 |

OTHER PUBLICATIONS

UK Intellectual Property Office,Office Action, Patent Application Serial No. GB1507911.4, dated May 26, 2015, UK.

* cited by examiner

*Primary Examiner* — Ali Alavi

(57) ABSTRACT

A recessed light fixture is provided. The recessed light fixture includes a casing having an inner wall and an outer wall to define a space; a front flange extending outward from the casing and surrounding the space, wherein the front flange has a top surface and a bottom surface; and an intumescent material disposed in a first recess of the outer wall and/or disposed on the top surface of the front flange.

20 Claims, 18 Drawing Sheets

RECESSED LIGHT FIXTURE

CROSS REFERENCE TO RELATED APPLICATIONS

This application claims the benefit of priority from a provisional application of U.S. Patent Application No. 62/009,393 filed on Jun. 9, 2014, entitled "THE METHOD FOR THE RECESSED LIGHTING FIXTURES WITH FIRE, ACOUSTICS, AND MOISTURE PROOF FUNCTION", the entirety of which is incorporated by reference herein.

BACKGROUND

Technical Field

The disclosure relates to a recessed light fixture, and in particular to a recessed light fixture with an intumescent material.

Description of the Related Art

Recessed lighting fixtures are installed into apertures in building structures, wherein the apertures may be on a ceiling or in a roof space of the building structures. However, it is impossible to make the dimensions of the aperture fit the light fixtures perfectly. There is always a gap between the recessed lighting fixture and ceiling. The gap can result in a high risk. When a fire breaks out, the fire and high-temperature smoke flows into the gap and then crosses to other spaces to spread.

Furthermore, when recessed lighting fixtures are installed in a humid environment such as a kitchen or a bathroom, moisture can pass through the gap, and the moisture can corrode the electric cables and terminals, which can cause a short-circuit and hence fire risk.

In addition, sometimes wind can blow into the roof or top ceiling space at a very high pressure, and the air flows through the gap at high speeds, causing a whistling noise. This can be uncomfortable for residents.

Therefore, a recessed light fixture which is fire-proof, moisture-proof and sound-muffling is needed.

SUMMARY

The present disclosure provides a recessed light fixture, including: a casing having an inner wall and an outer wall to define a space; a front flange extending outward from the casing and surrounding the space, wherein the front flange has a top surface and a bottom surface; and an intumescent material disposed in a first recess of the outer wall and/or disposed on the top surface of the front flange.

A detailed description is given in the following embodiments with reference to the accompanying drawings.

BRIEF DESCRIPTION OF THE DRAWINGS

The disclosure may be more fully understood by reading the subsequent detailed description and examples with references made to the accompanying drawings, wherein.

DETAILED DESCRIPTION

Figure 1A:
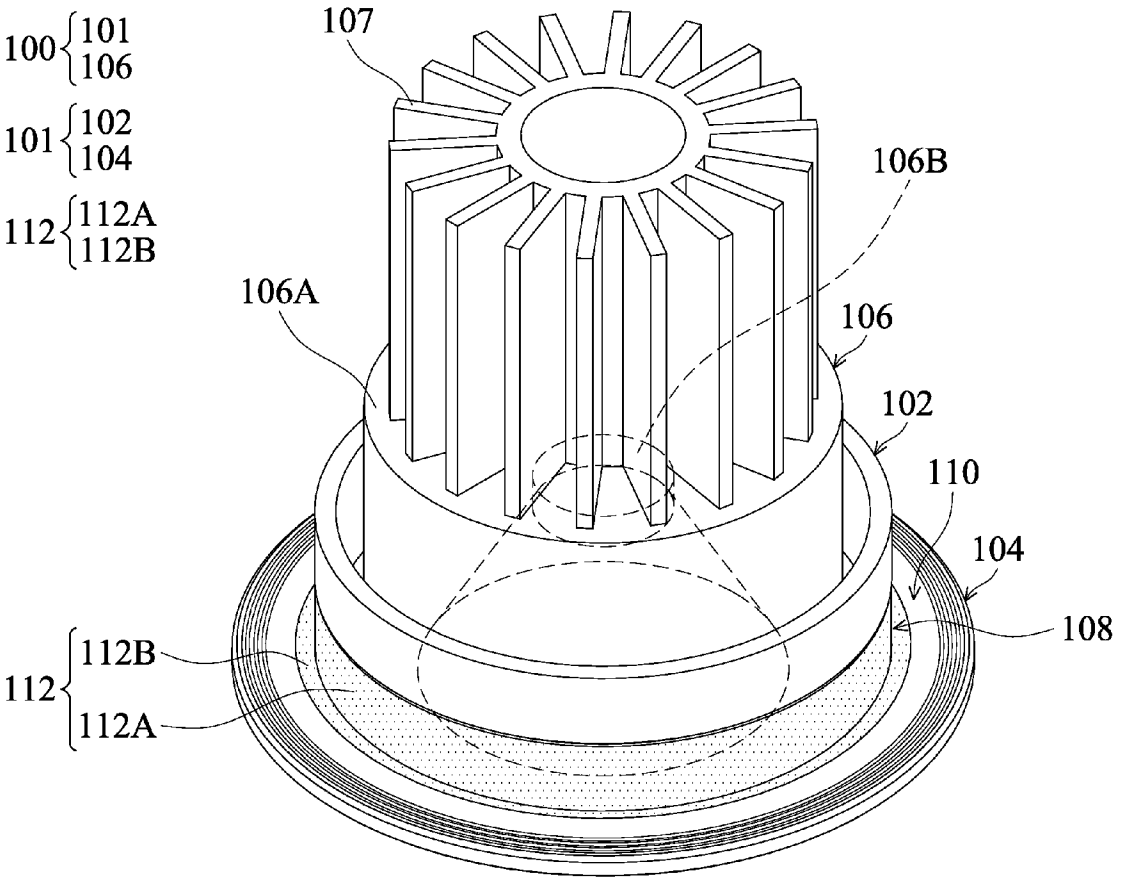
FIG. 1A is a perspective view of a recessed light fixture when viewed from a tilted angle in accordance with some embodiments of the present disclosure.

The recessed light fixture of the present disclosure are described in detail in the following description. In the following detailed description, for purposes of explanation, numerous specific details and embodiments are set forth in order to provide a thorough understanding of the present disclosure. The specific elements and configurations described in the following detailed description are set forth in order to clearly describe the present disclosure. It will be apparent, however, that the exemplary embodiments set forth herein are used merely for the purpose of illustration, and the inventive concept may be embodied in various forms without being limited to those exemplary embodiments. In addition, the drawings of different embodiments may use like and/or corresponding numerals to denote like and/or corresponding elements in order to clearly describe the present disclosure. However, the use of like and/or corresponding numerals in the drawings of different embodiments does not suggest any correlation between different embodiments. In addition, in this specification, expressions such as "one element disposed on/over one layer", may indicate not only the direct contact of the two elements, but also, a non-contact state of the two elements. In the above situation, the two elements may not directly contact.

It should be noted that the elements or devices in the drawings of the present disclosure may be present in any form or configuration known to those skilled in the art. In addition, the expression "a layer overlying another layer", "a layer is disposed above another layer", "a layer is disposed on another layer" and "a layer is disposed over another layer" may indicate that the layer directly contacts the other layer, but it may also indicate that the layer does not directly contact the other layer, there being one or more intermediate layers disposed between the layer and the other layer.

In addition, in this specification, relative expressions are used. For example, "lower", "bottom", "higher" or "top" are used to describe the position of one element relative to another. It should be appreciated that if a device is flipped upside down, an element that is "lower" will become an element that is "higher".

The terms "about" and "substantially" typically mean +/−20% of the stated value, more typically +/−10% of the stated value, more typically +/−5% of the stated value, more typically +/−3% of the stated value, more typically +/−2% of the stated value, more typically +/−1% of the stated value and even more typically +/−0.5% of the stated value. The stated value of the present disclosure is an approximate value. When there is no specific description, the stated value includes the meaning of "about" or "substantially".

It should be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Unless defined otherwise, all technical and scientific terms used herein have the same meaning as commonly understood to one of ordinary skill in the art to which this invention belongs. It should be appreciated that, in each case, the term, which is defined in a commonly used dictionary, should be interpreted as having a meaning that conforms to the relative skills and the background or the context of the present disclosure, and should not be interpreted in an idealized or overly formal manner unless so defined.

The present disclosure utilizes an intumescent material disposed in a recess to improve the fireproof ability of the recessed light fixture. In addition, the present disclosure also utilizes a barrier pad to give the recessed light fixture moisture-proofing and sound-proofing properties.

Figure 1B:
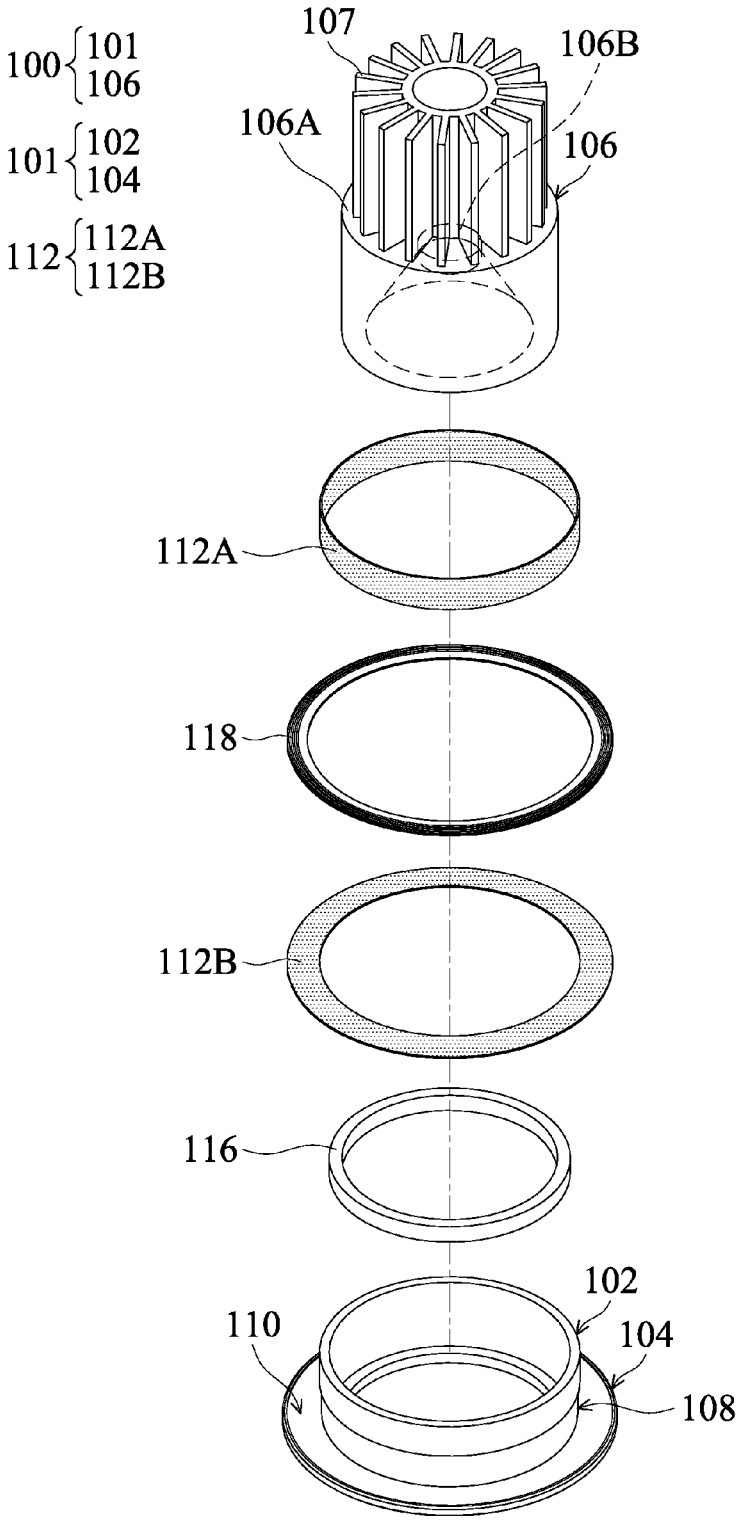
FIG. 1B is an exploded view of the recessed light fixture in FIG. 1A.
Figure 1C:
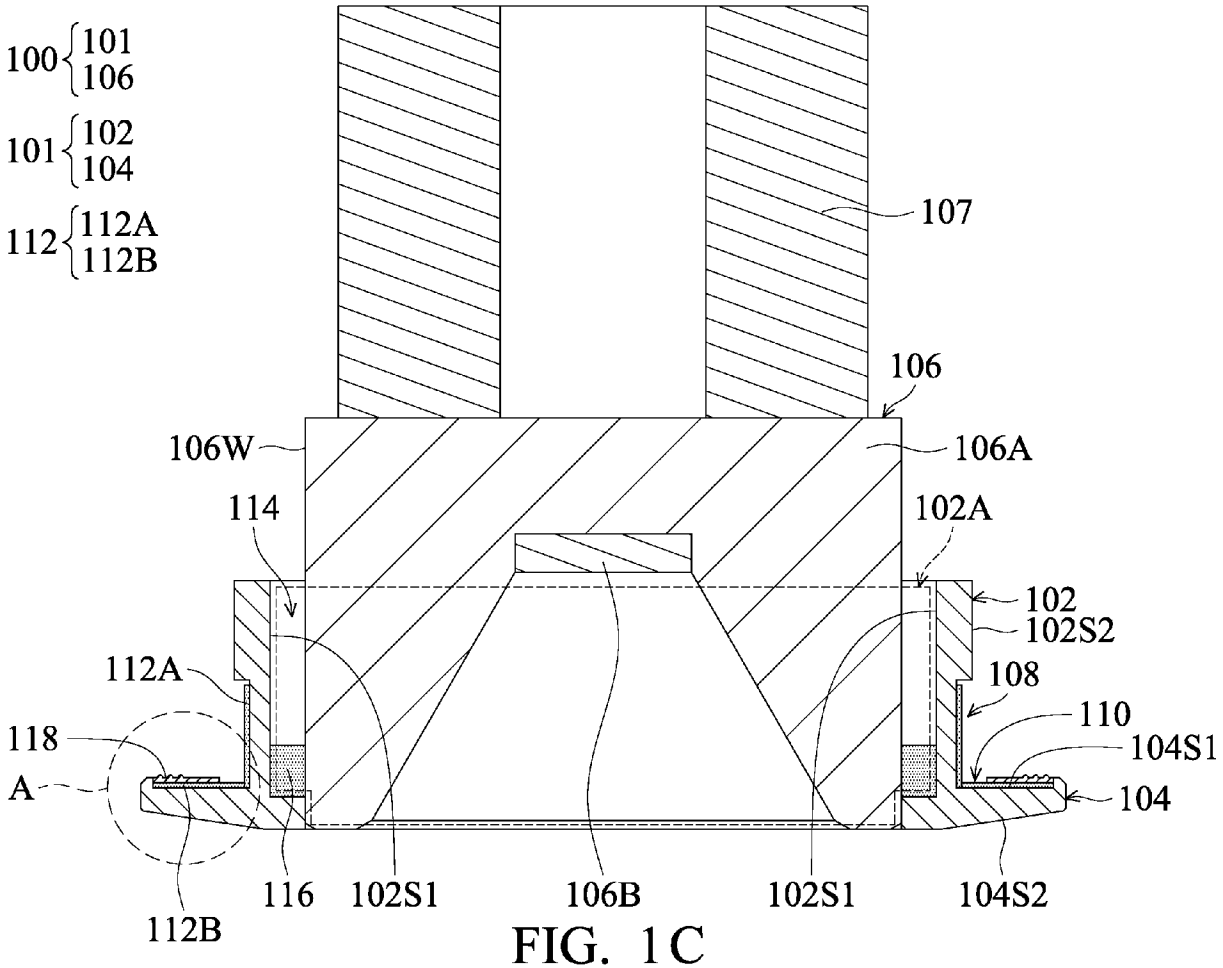
FIG. 1C is a cross-sectional view of a recessed light fixture in accordance with some embodiments of the present disclosure.
Figure 1D:
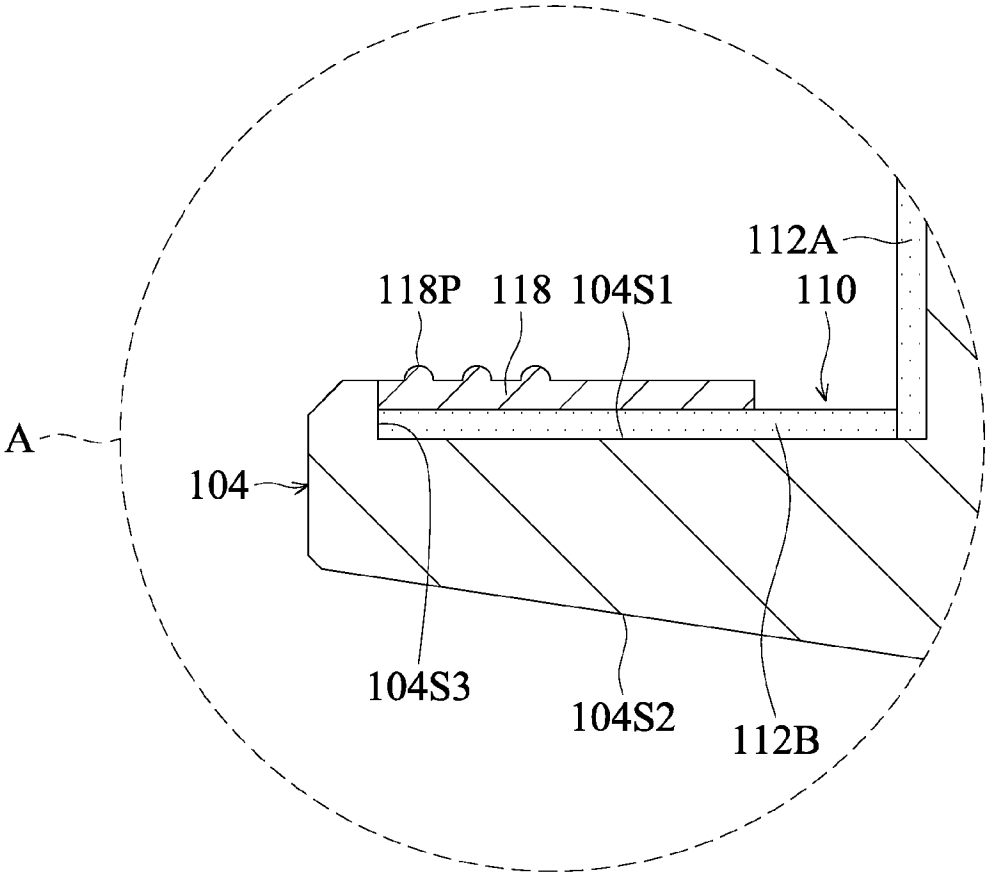
FIG. 1D is an enlarged figure of portion A of the recessed light fixture in FIG. 1C.
Figure 1E:
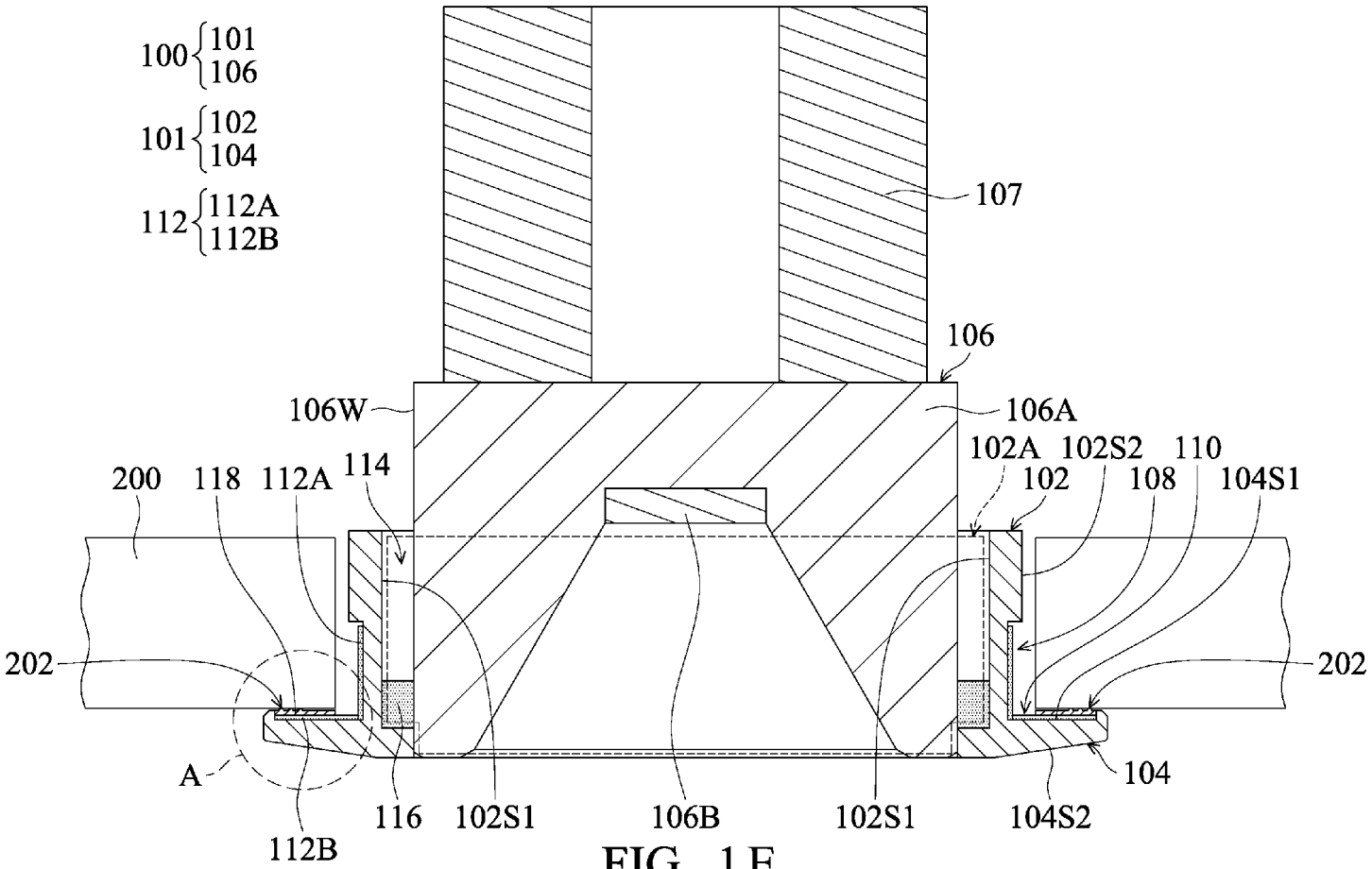
FIG. 1E is a cross-sectional view of the recessed light fixture in accordance with some embodiments of the present disclosure after being installed in a building.
Figure 1F:
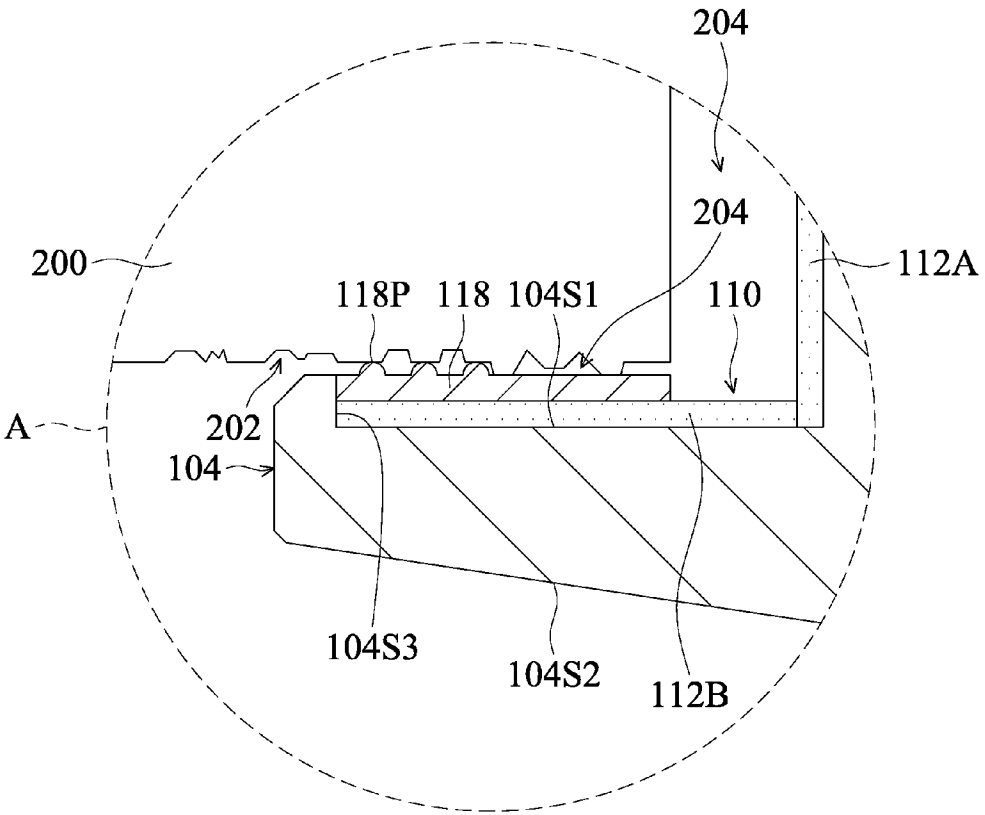
FIG. 1F is an enlarged figure of portion A of the recessed light fixture in FIG. 1E.

Referring to FIGS. 1A-1D FIG. 1A is a perspective view of a recessed light fixture when viewed from a tilted angle in accordance with some embodiments of the present disclosure, FIG. 1B is an exploded view of the recessed light fixture in FIG. 1A, FIG. 1C is a cross-sectional view of this recessed light fixture, and FIG. 1D is an enlarged figure of portion A of the recessed light fixture in FIG. 1C. As shown in these figures, the recessed light 100 includes a recessed light fixture 101 and a lamp 106. The recessed light fixture 101 includes a casing 102 and a front flange 104. The recessed lighting fixtures 101 may be installed into the aperture in a building 200 as shown in FIGS. 1E and 1F. FIG. 1E is a cross-sectional view of the recessed light fixture 101 after being installed into the building 200, and FIG. 1F is an enlarged figure of portion A of the recessed light fixture in FIG. 1E. The building 200 may include, but is not limited to, a ceiling, a roof space, a wall, a floor, or any other structure which is suitable to have an aperture for installing the lighting fixtures.

The casing 102 is adapted to house the lamp 106. The casing 102 having an inner wall 102S1 and an outer wall 102S2, and the inner wall 102S1 defines a space 102A. The front flange 104 extends outwardly from the casing 102 and surrounds the space 102A. In addition, the front flange 104 has a top surface 104S1 and a bottom surface 104S2. The lamp 106 is disposed within the space 102A of the casing 102. In addition, the lamp 106 may include a base 106A and a light-emitting element 106B. Further, a heat spreader 107 is provided to spread out the heat produced by the lamp 106. The base 106A is used to hold the light-emitting element 106B. The light-emitting element 106B may include, but is not limited to, a light emitting diode, a halogen lamp, or any other suitable lamp.

In addition, the outer wall 102S2 of the casing 102 has a first recess 108 which may be near the front flange 104, and the front flange 104 includes a second recess 110 disposed on the top surface 104S1. The first recess 108 may connect with the second recess 110 as shown in FIG. 1C. The recessed light fixture 101 further includes an intumescent material 112 disposed in the first recess 108 and/or disposed on the top surface 104S1 of the front flange 104. In particular, the intumescent material 112 is disposed in the first recess 108 of the outer wall 102S2 of the casing 102 and/or the second recess 110 of the top surface 104S1 of the front flange 104.

For example, in one embodiment, referring to FIGS. 1A-1C, the intumescent material 112 may include a first intumescent material 112A and a second intumescent material 112B. The first intumescent material 112A is disposed in the first recess 108 of the outer wall 102S2, and the second intumescent material 112B is disposed in the second recess 110. In addition, one side of the first intumescent material 112A may directly contact the top surface 104S1 of the front flange 104, and the second intumescent material 112B may directly contact the first intumescent material 112A, as shown in FIG. 1C.

As shown in FIG. 1F, by disposing the intumescent material 112, which is fire protection material, in the recess such as the first recess 108 and/or the second recess 110, the fireproof ability of the recessed light fixture 101 may be improved. Specifically, in the event of a fire, the intumescent material 112 (or the first intumescent material 112A and the second intumescent material 112B) may expand at its onset temperature to fill any gaps 204 between the recessed light fixture 101 and the building 200. The gaps 204 refer to the region between the top surface 104S1 of the front flange 104 and the building 200 and the region between the outer wall 102S2 of the casing 102 and the building 200. Note that the gap 204 between the top surface 104S1 of the front flange 104 and the building 200 is resulted from the irregularities 202 of the recessed light fixture 101. Specifically, since the irregularities 202 of the recessed light fixture 101 merely contact the top surface 104S1 of the front flange 104 at several points rather than an entire surface, the gap 204 is formed therebetween. Note that the gap 204 is also formed outward and inward the plane of FIG. 1F at the region corresponding to the irregularities 202. Hence, the first intumescent material 112A and the second intumescent material 112B provide an effective seal against the passage of fire and smoke. Besides, by disposing the first intumescent material 112A in the first recess 108, the damage and malfunction of the first intumescent material 112A may be prevented when installing the recessed light fixture 101 into the building 200 and the fireproof ability of the recessed light fixture 101 may be ensured.

In addition, since the second intumescent material 112B is closer to the fire in the event of a fire, the second intumescent material 112B would be heated and expand more quickly than the first intumescent material 112A and may also fill the gaps 204 between the recessed light fixture 101 and the building 200. Therefore, the second intumescent material 112B may further improve the fireproof ability of the recessed light fixture 101. Alternatively, since the second intumescent material 112B may fill the gaps 204 between the recessed light fixture 101 and the building 200 by itself, the second intumescent material 112B itself alone may also provide the fireproof ability of the recessed light fixture 101.

The intumescent material 112 may include, but is not limited to, graphite-based intumescent material, silicone-based intumescent material, mastic-based intumescent material, organic-based intumescent material or water-based intumescent material, or any other suitable intumescent material, or a combination thereof. For example, one suitable intumescent material is a (preferably non-alkaline) fibreglass containing intumescent sheet material, including 50 wt % of ceramic fibre, 10 wt % of organic fibre, 10 wt % of adhesive and 30 wt % of intumescent, and the intumescent material may be doped with $SiO_2$, $Al_2O_3$, CaO, MgO and $B_2O_3$.

In addition, the onset temperature of the intumescent material 112 is 100° C. or higher. For example, the onset temperature of the intumescent material 112 is 150° C. or higher. The onset temperature is the temperature at which the intumescent material 112 begins to expand. In addition, the free expansion ratio of the intumescent material 112 is 20:1 or higher. For example, the free expansion ratio of the intumescent material 112 is 50:1, 60:1 or higher. It should be noted that, if the free expansion ratio of the intumescent material 112 is too low, for example, lower than 20:1, the expanded intumescent material 112 cannot effectively fill the gaps 204 between the recessed light fixture 101 and the building 200 in the event of a fire, which in turn makes the recessed light fixture 101 unable to stop the fire or smoke from spreading. The free expansion ratio of the intumescent material refers to the expansion ratio of the intumescent material without any obstruction. In other words, if an intumescent material has a free expansion ratio of 20:1, it means the intumescent material is able to expand to fill 20 times its own initial volume when exposed to the heat of a fire without any obstruction.

Referring to FIG. 1C, the recessed light 100 may further include a gap 114 between the wall 106W of the lamp 106 and the inner wall 102S1 of the casing 102. An intumescent glue 116 may be partially filled into the gap 114 to further improve the fireproof ability of the recessed light 100. Specifically, in the event of a fire, the casing 102 may be melted due to the heat of the fire. The fire and high-temperature smoke will flow into the gap 114 between the lamp 106 and the casing 102 and then cross to the other space to spread the fire. Therefore, by putting the intumescent glue 116 in the gap 114, the intumescent glue 116 may expand in the event of a fire to completely fill the gap 114 and stop the fire and high-temperature smoke from flowing into the gap 114. Therefore, the intumescent glue 116 may further improve the fireproof ability of the recessed light 100.

The intumescent glue 116 may include, but is not limited to, graphite-based intumescent material, silicone-based intumescent material, mastic-based intumescent material, organic-based intumescent material or water-based intumescent material, or any other suitable intumescent material, or a combination thereof. For example, one suitable intumescent material is a (preferably non-alkaline) fibreglass containing intumescent sheet material, including 50 wt % of ceramic fibre, 10 wt % of organic fibre, 10 wt % of adhesive and 30 wt % of intumescent, and the intumescent material may be doped with $SiO_2$, $Al_2O_3$, CaO, MgO and $B_2O_3$.

As illustrated in FIGS. 1A and 1B, the recessed light fixture 101 may further include a barrier pad 118 disposed in the second recess 110. According to the aforementioned description, when the recessed lighting fixtures 101 are installed in a humid environment such as a kitchen or a bathroom, moisture will pass through gaps 204 between the recessed light fixture 101 and the building 200, and then the moisture can corrode the electric cables and terminals, which can cause a short-circuit and fire risk. By disposing a barrier pad 118 in the second recess 110, the moisture may be prevented from passing through the gaps 204 between the recessed light fixture 101 and the building 200 and the risk of fire may be lowered.

In addition, the air flowing through the gaps 204 at high wind speed would make big noise. The barrier pad 118 in the second recess 110 may also prevent the air from flowing through the gaps 204, and thus lower the noise. Therefore, the barrier pad 118 in the second recess 110 of the present disclosure may give the recessed light fixture 101 moisture-proofing and sound-proof ability and may lower the risk of fire. The material of the barrier pad 118 may include, but is not limited to, polymer, synthetic rubber, or any other suitable barrier material, or a combination thereof.

In one embodiment, referring to FIG. 1C or FIG. 1D, the barrier pad 118 is directly disposed over the second intumescent material 112B in the second recess 110. The second intumescent material 112B and the barrier pad 118 are both in direct contact with the inner wall 104S3 in the second recess 110 of the front flange 104. In addition, the barrier pad 118 is not in contact with the first intumescent material 112A. In other words, the barrier pad 118 does not completely cover all top surface of the second intumescent material 112B, and a portion of the second intumescent material 112B is exposed from the barrier pad 118, as shown in FIG. 1C or FIG. 1D. Since the intumescent material 112 such as the second intumescent material 112B needs space to initiate expansion, if the barrier pad 118 completely covers all top surface of the second intumescent material 112B, the second intumescent material 112B may not be able to successfully initiate the expansion. Therefore, the exposure of the second intumescent material 112B from the barrier pad 118 can help the second intumescent material 112B initiate the expansion successfully.

Similarly, in one embodiment, the first intumescent material 112A does not completely fill the first recess 108. A space is left in the first recess 108 to make the first intumescent material 112A be able to initiate the expansion successfully, as shown in FIG. 1C.

It should be noted that, although the barrier pad is directly disposed over the second intumescent material in the embodiments shown in FIGS. 1A and 1B, those skilled in the art will appreciate that other configurations of the barrier pad and the intumescent material may also be applicable. This will be described in detail in the following description. Therefore, the exemplary embodiments set forth in FIGS. 1A and 1B are merely for the purpose of illustration, and the inventive concept may be embodied in various forms without being limited to the exemplary embodiments as shown in FIGS. 1A and 1B.

Figure 2:
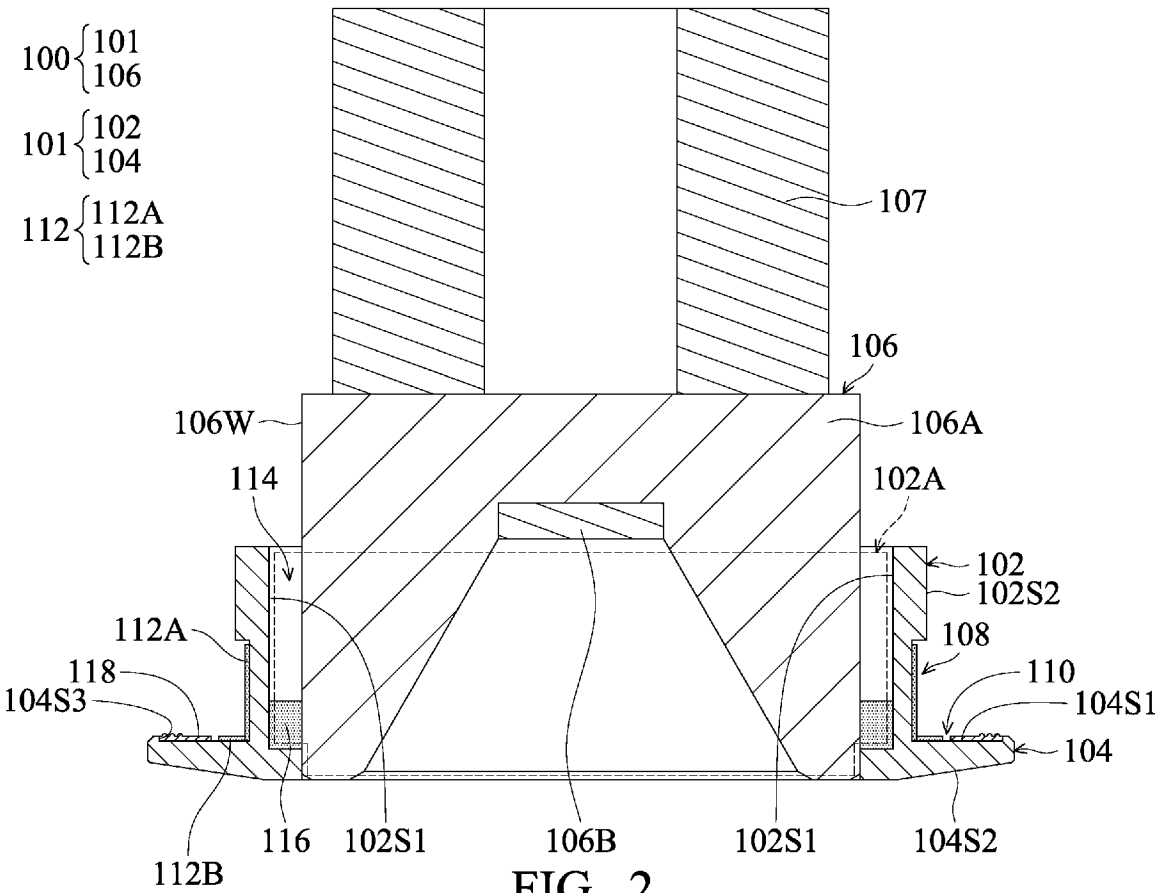
FIG. 2 is a cross-sectional view of a recessed light fixture in accordance with another embodiment of the present disclosure.

Referring to FIG. 2, which is a cross-sectional view of a recessed light fixture in accordance with another embodiment of the present disclosure. Note that the same or similar elements or layers corresponding to those of the recessed light fixture are denoted by like reference numerals. The same or similar elements or layers denoted by like reference numerals have the same meaning and will not be repeated for the sake of brevity.

Unlike the embodiment shown in FIGS. 1A and 1B, the barrier pad 118 in FIG. 2 does not contact the intumescent material 112 such as the second intumescent material 112B, and is not directly disposed over the second intumescent material 112B, as shown in the embodiments shown in FIGS. 1A and 1B. In FIG. 2, the barrier pad 118 and the second intumescent material 112B surround the casing. Besides, one side of the barrier pad 118 directly contacts the inner wall 104S3 of the front flange 104, and the other side of the barrier pad 118 is spaced apart from the second intumescent material 112B by a distance in the second recess 110. Since the second intumescent material 112B is not covered by the barrier pad 118, the second intumescent material 112B has sufficient space to initiate the expansion. Therefore, this configuration shown in FIG. 2 may further improve the fireproof ability of the recessed light fixture 101.

Figure 3A:
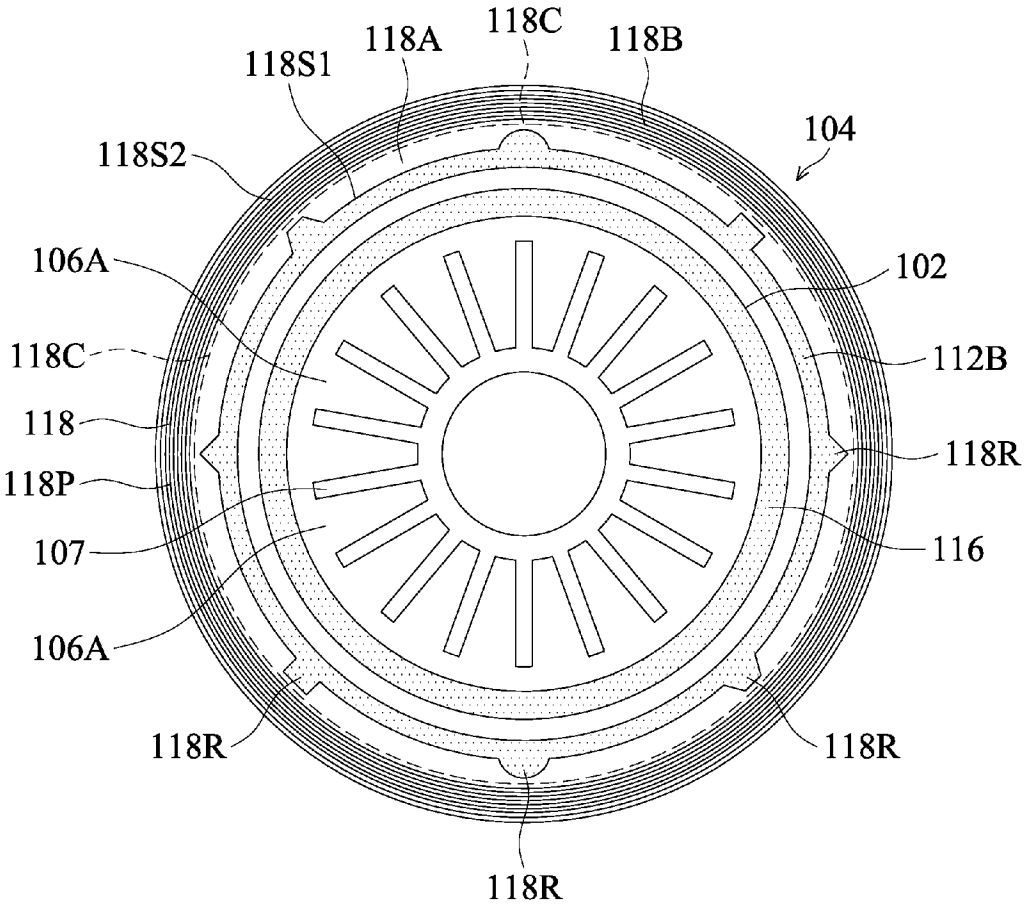
FIG. 3A is a top view of a recessed light fixture in accordance with a further embodiments of the present disclosure.
Figure 3B:
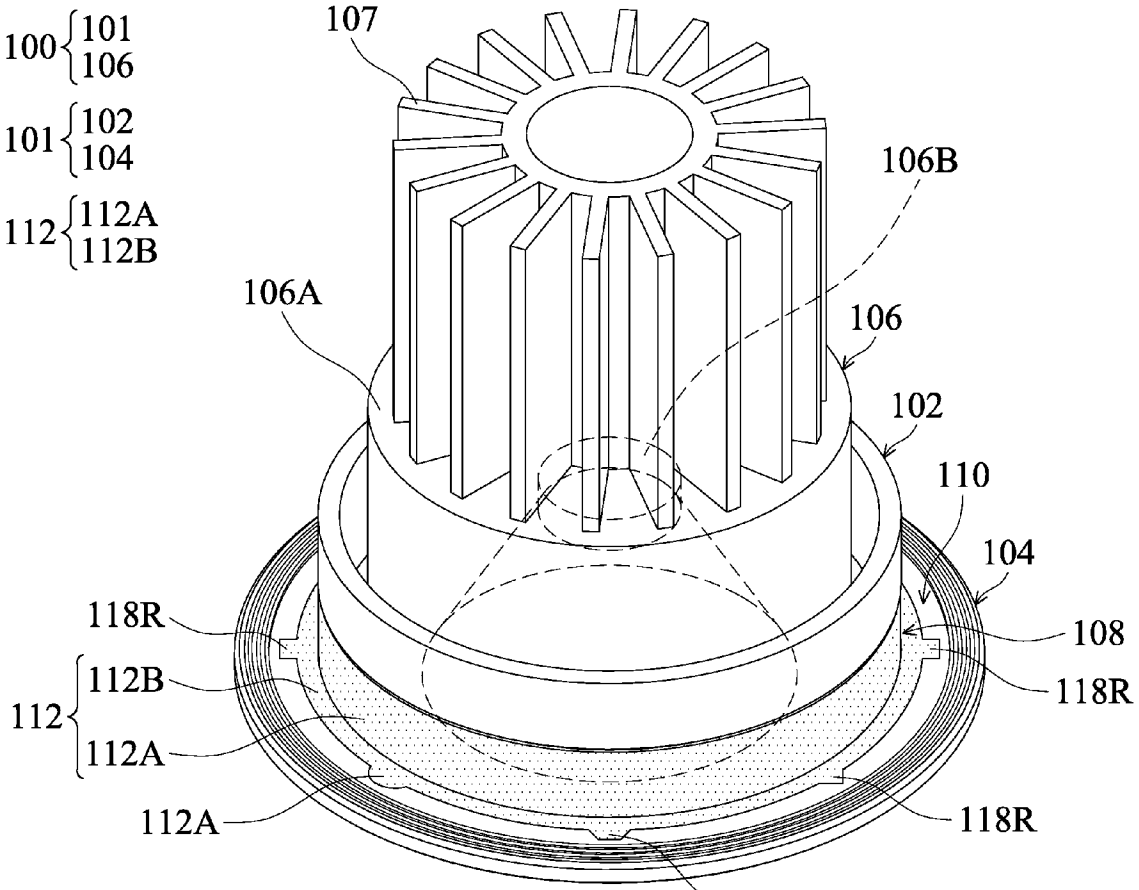
FIG. 3B is a perspective view of the recessed light fixture in FIG. 3A.
Figure 4A:
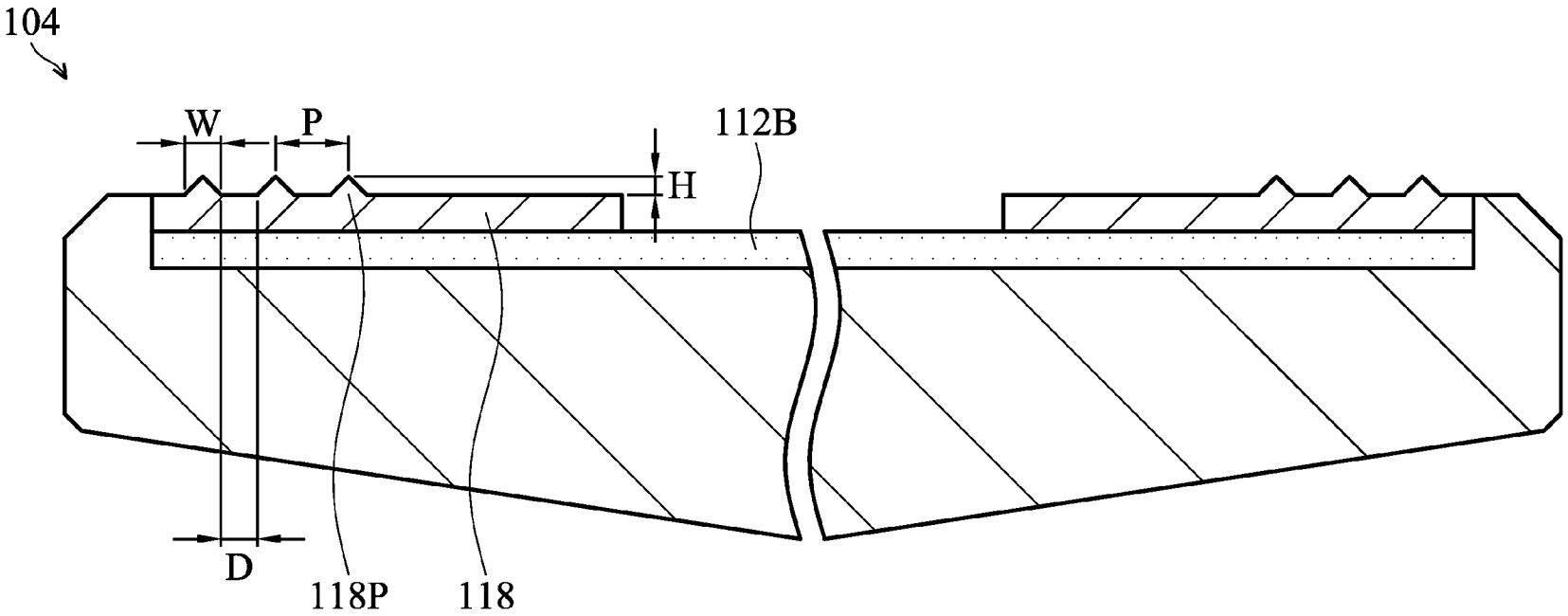
FIGS. 4A-4D are cross-sectional views of a recessed light fixture in accordance with some embodiments of the present disclosure.
Figure 4B:
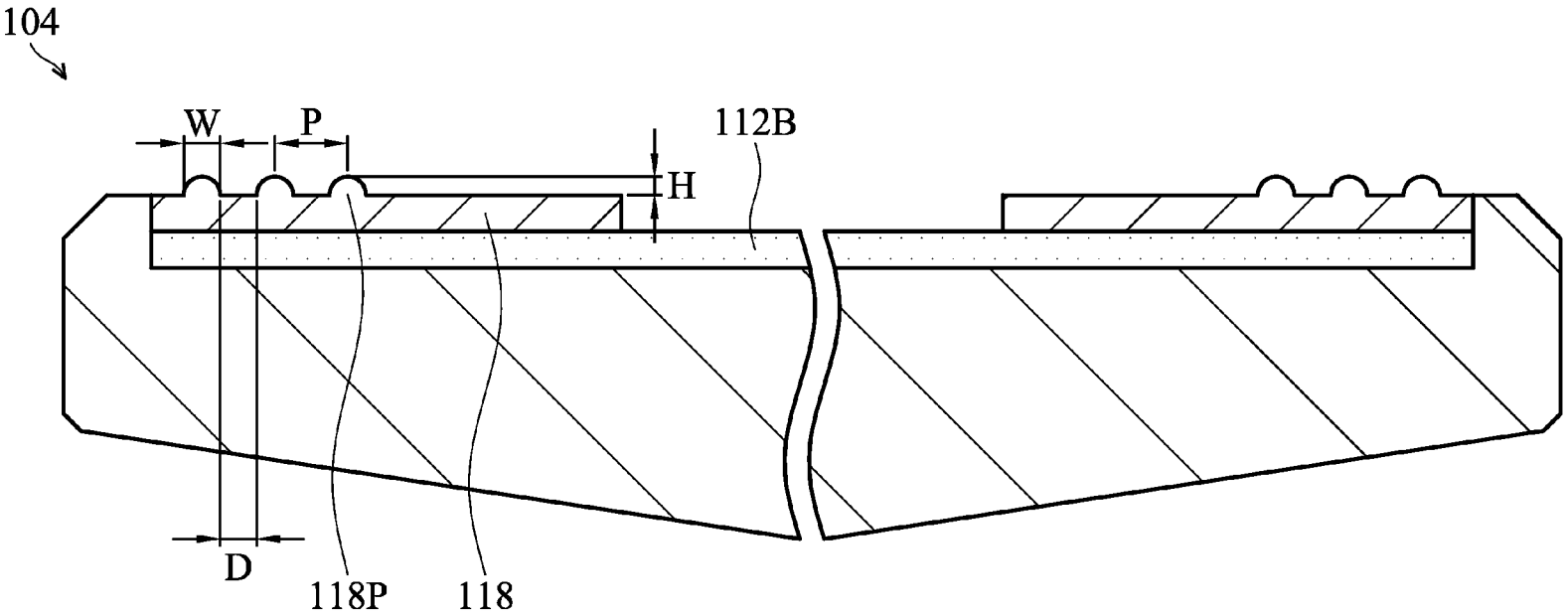
Figure 4C:
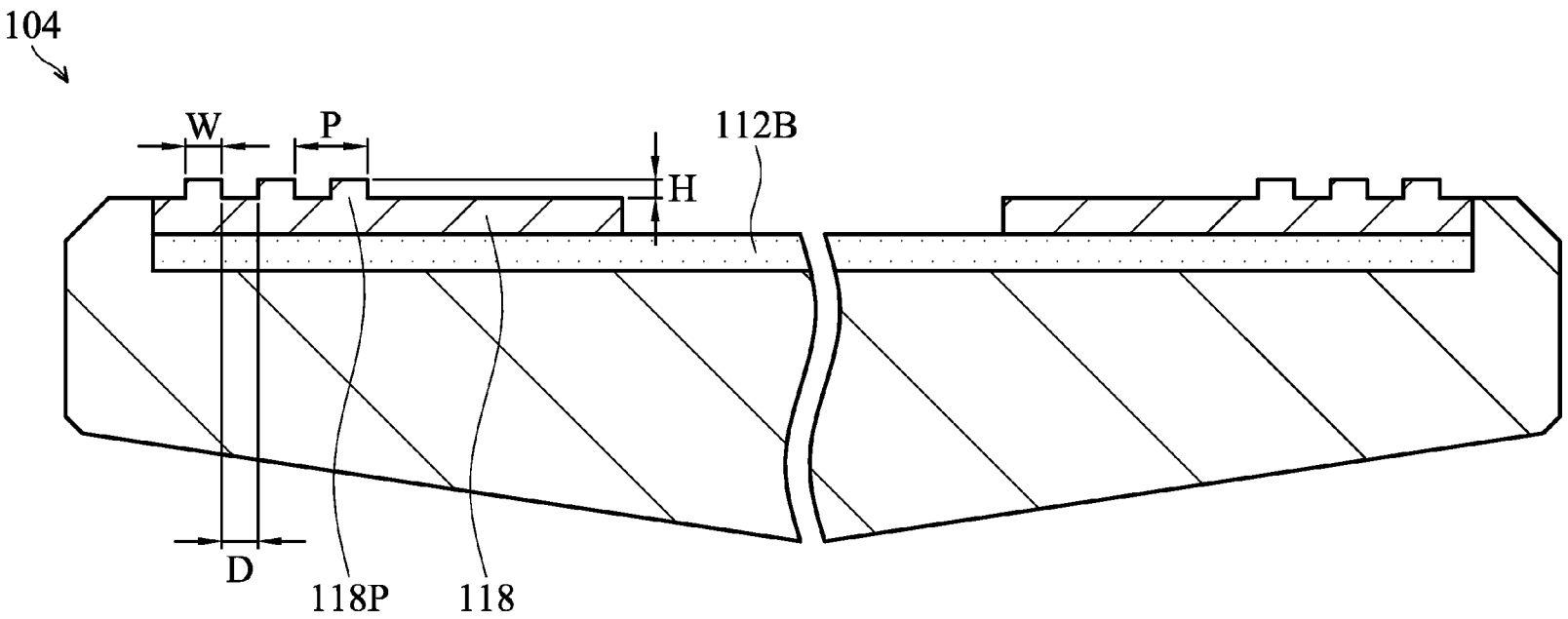
Figure 4D:
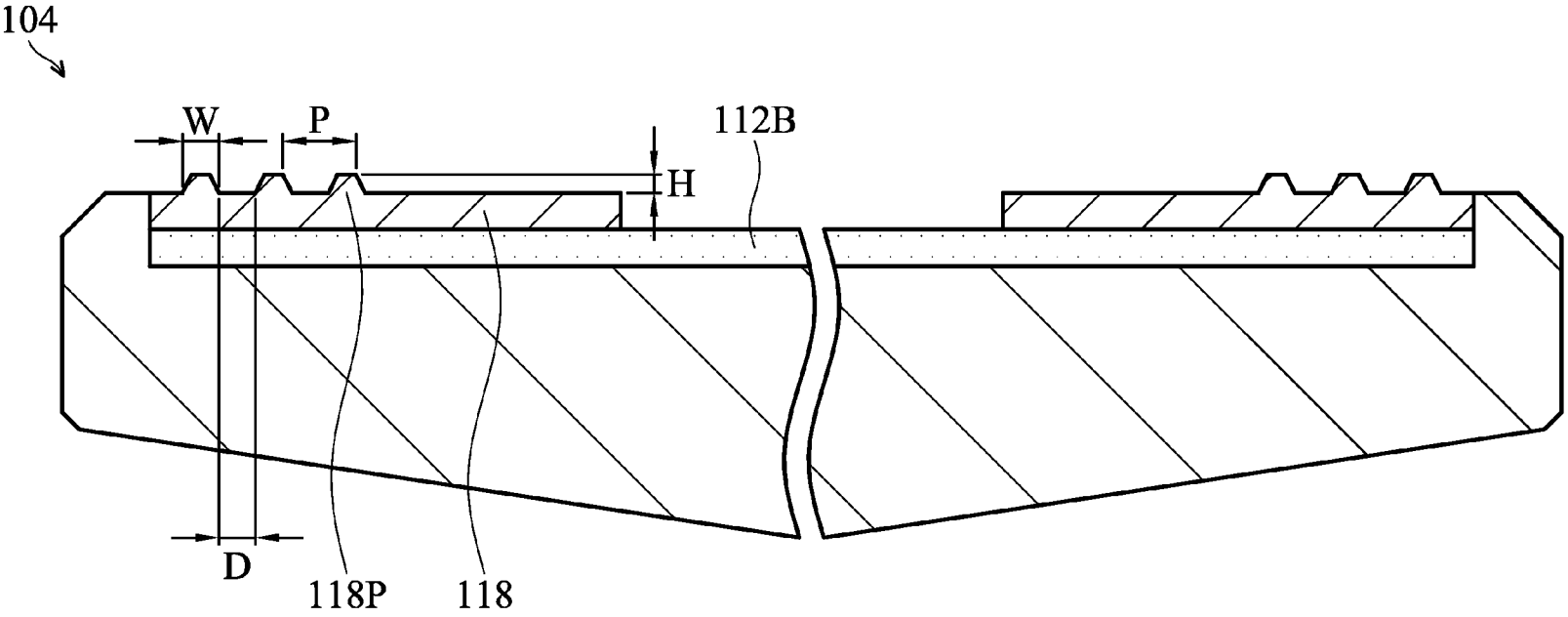

FIG. 3A is a top view of a recessed light fixture in accordance with a further embodiments of the present disclosure. FIG. 3B is a perspective view of the recessed light fixture in FIG. 3A. As shown in these figures, the barrier pad 118 may include a plurality of cuts 118R at an inner side 118S1 of the barrier pad 118. In particular, the barrier pad 118 has an inner portion 118A and an outer portion 118B which are divided by the dotted line 118C located at about 50% width of the barrier pad 118. The inner portion 118A is the portion of the barrier pad 118 inside the dotted line 118C and closer to the casing 102, whereas the outer portion 118B is the portion of the barrier pad 118 outside the dotted line 118C and closer to the inner wall 104S3 of the front flange 104. The plurality of the cuts 118R is disposed at the inner portion 118A of the barrier pad 118.

As shown in FIG. 3A, the cuts 118R may further expose the underlying second intumescent material 112B. Therefore, the second intumescent material 112B may initiate the expansion more successfully due to the cuts 118R, and the fireproof ability of the recessed light fixture 101 may be further improved. In addition, since the cuts 118R expose specific portions of the underlying second intumescent material 112B, the cuts 118R may be used to control which portion of the second intumescent material 112B is used to initiate the expansion.

In addition, the plurality of the cuts 118R may have a triangular shape, a semicircular shape, a rectangular shape, a trapezoidal shape, or a shape of any other suitable shape, as shown in FIG. 3A. The area ratio of the plurality of the cuts 118R to the barrier pad 118 without the cuts 118R may range from about 5% to 30%, for example from about 10% to 20%. It should be noted that, if the area ratio of the plurality of the cuts 118R to the barrier pad 118 without the cuts 118R is too large, for example greater than 30%, the area of the barrier pad 118 having the cuts 118R would be too small and thus the barrier pad 118 cannot effectively prevent the moisture and air from passing through the gaps 204 between the recessed light fixture and the building 200. However, if the area ratio of the plurality of the cuts 118R to the barrier pad 118 without the cuts 118R is too small, for example smaller than 5%, the cuts 118R cannot effectively improve the fireproof ability of the recessed light fixture 101.

As seen in FIG. 3A, the barrier pad 118 may further include at least one annular protrusion 118P. In particular, the annular protrusion 118P is disposed at the outer portion 118B of the barrier pad 118. Since the annular protrusion 118P protrudes upward from the surface of the barrier pad 118, it may further fill the gaps 204 between the recessed light fixture 101 and the building 200 and may further prevent moisture and air from passing through the gaps 204 between the recessed light fixture 101 and the building 200. Therefore the risk of fire may be further decreased and noise may be further reduced.

FIGS. 4A-4D are cross-sectional views of a recessed light fixture 101 in accordance with some embodiments of the present disclosure. Note that the casing 102 and the lamp 106 are omitted in FIGS. 4A-4D for the sake of brevity. As shown in FIGS. 4A-4D, the annular protrusion 118P may have a triangular cross-section, a semicircular cross-section, a rectangular cross-section, a trapezoidal cross-section, or a cross-section of any other suitable shape.

Still referring to FIGS. 4A-4D, the pitch P between any two of the plurality of annular protrusions 118P may range from about 0.3 mm to 1 mm, for example from about 0.5 mm to 0.7 mm. It should be noted that, if the pitch P is too large, for example greater than 1 mm, the annular protrusion 118P cannot effectively prevent moisture and air from passing through the gaps 204 between the recessed light fixture 101 and the building 200.

In addition, the distance D from an edge of one annular protrusion 118P to an edge of an adjacent annular protrusion 118P may range from about 0.2 mm to 0.8 mm, for example from about 0.3 mm to 0.7 mm. It should be noted that, if the distance D is too large, for example greater than 0.8 mm, the annular protrusion 118P cannot effectively prevent the moisture and air from passing through the gaps 204 between the recessed light fixture 101 and the building 200.

Still referring to FIGS. 4A-4D, the width W of the annular protrusion 118P may range from about 0.1 mm to 0.4 mm, for example from about 0.2 mm to 0.3 mm. It should be noted that, if the width W is too great, for example greater than 0.4 mm, the annular protrusion 118P cannot effectively prevent the moisture and air from passing through the gaps 204 between the recessed light fixture 101 and the building 200.

In addition, the height H of the annular protrusion 118P may range from about 0.1 mm to 1 mm, for example from about 0.3 mm to 0.7 mm. It should be noted that, if the height H is too small, for example smaller than 0.1 mm, the annular protrusion 118P cannot effectively prevent the moisture and air from passing through the gaps 204 between the recessed light fixture 101 and the building 200.

Figure 5A:
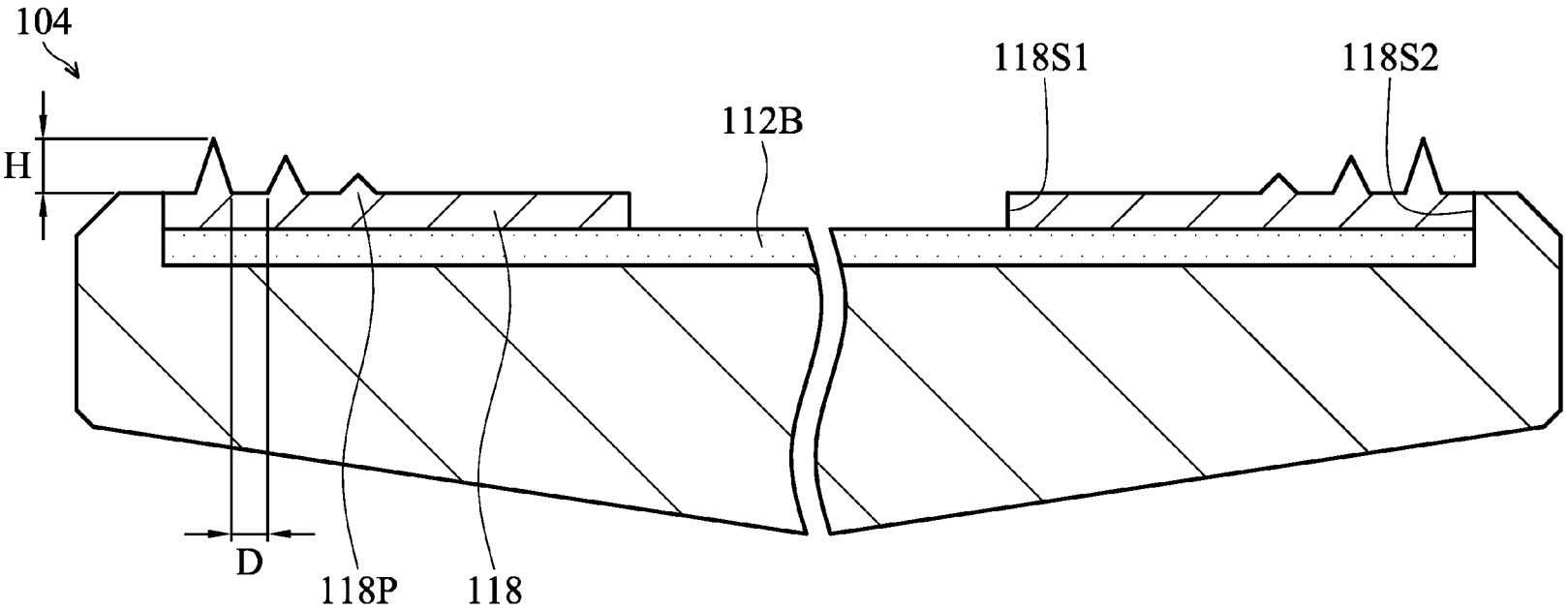
FIGS. 5A-5B are cross-sectional views of a recessed light fixture in accordance with another embodiment of the present disclosure.
Figure 5B:
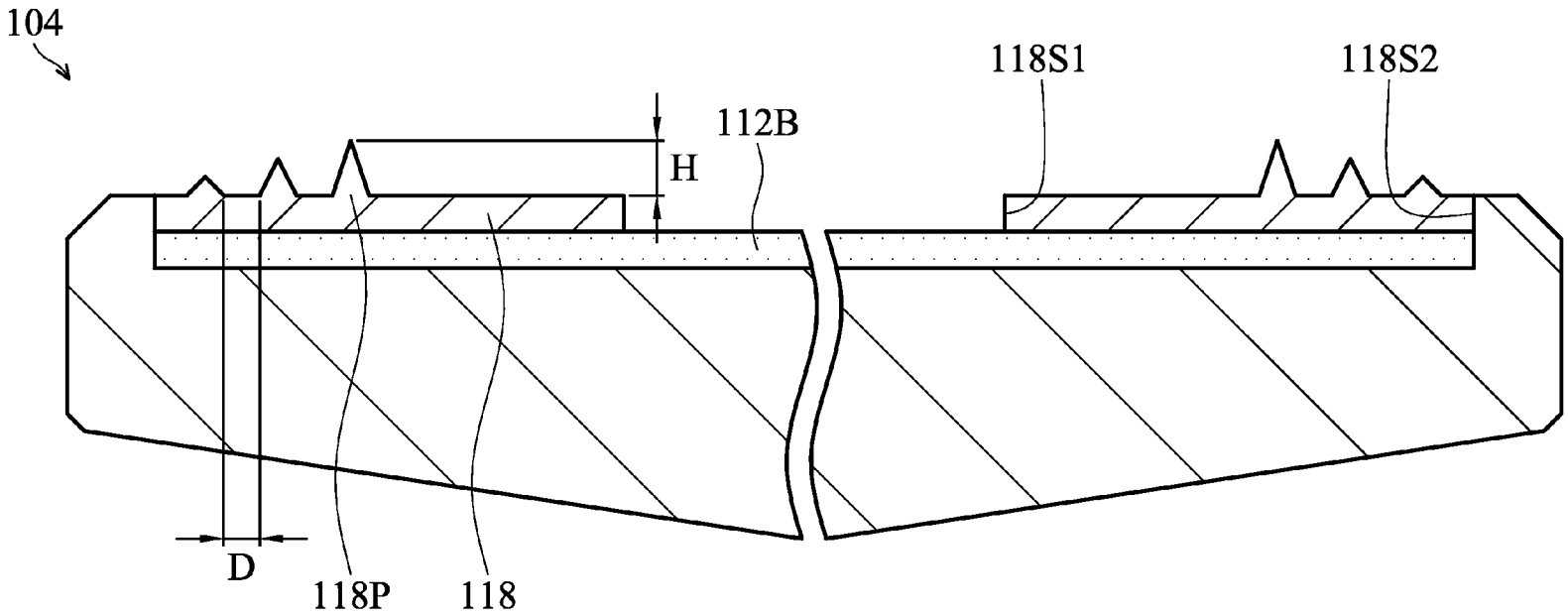

FIGS. 5A-5B are cross-sectional views of a recessed light fixture 101 in accordance with some embodiment of the present disclosure. In one embodiment, as shown in FIG. 5A, the heights H of the plurality of the annular protrusions 118P may decrease from a periphery 120 (or the outer side 118S2) of the barrier pad 118 to a center 122 (or the inner side 118S1) of the barrier pad 118. This height variation of the annular protrusions 118P may further prevent the moisture and air from passing through the gaps 204 between the recessed light fixture 101 and the building 200. Therefore the risk of fire may be further decreased and the noise may be further reduced.

In another embodiment, as shown in FIG. 5B, the heights H of the plurality of annular protrusions 118P may increase from a periphery 120 (or the outer side 118S2) of the barrier pad 118 to a center 122 (or the inner side 118S1) of the barrier pad 118. This height variation of the annular protrusions 118P may also further prevent the moisture and air from passing through the gaps 204 between the recessed light fixture 101 and the building 200. Therefore the risk of fire may be further decreased and the noise may be further reduced.

It should be noted that, although the barrier pad 118 includes only three annular protrusions 118P in the embodiments shown in FIGS. 5A and 5B, those skilled in the art will appreciate that the barrier pad may include one, two or more than three annular protrusions. Therefore, the exemplary embodiments set forth in FIGS. 5A and 5B are merely for the purpose of illustration, and the inventive concept may be embodied in various forms without being limited to the exemplary embodiments as shown in FIGS. 5A and 5B.

It should be noted that, although the recessed light fixture includes the first intumescent material and the second intumescent material in the embodiments shown in FIGS. 1A-5B, those skilled in the art will appreciate that the recessed light fixture may include only the first intumescent material or only the second intumescent material in other embodiments. This will be described in detail in the following description. Therefore, the exemplary embodiments set forth in FIGS. 1A-5B are merely for the purpose of illustration, and the inventive concept may be embodied in various forms without being limited to the exemplary embodiments as shown in FIGS. 1A-5B.

Figure 6A:
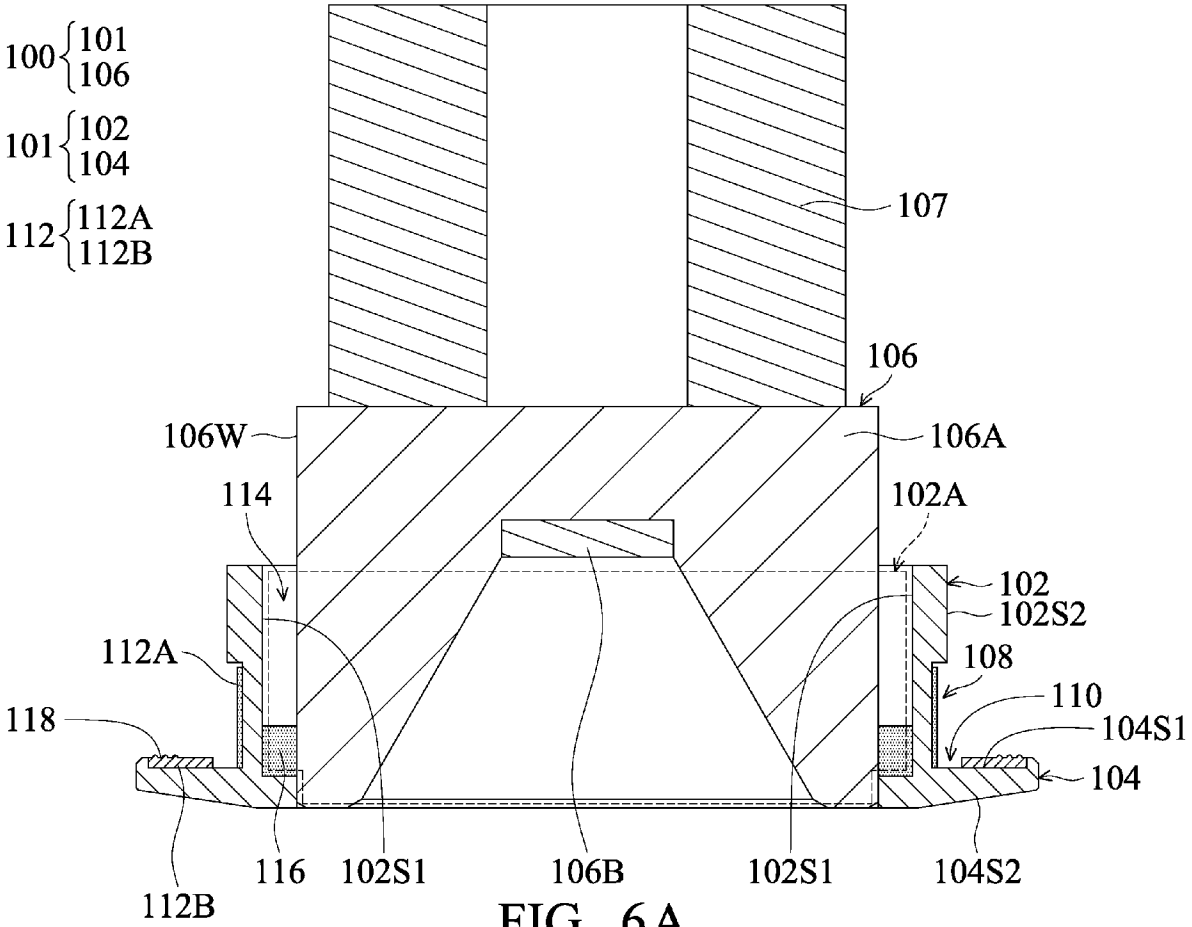
FIG. 6A is a cross-sectional view of a recessed light fixture in accordance with another embodiment of the present disclosure.

FIG. 6A is a cross-sectional view of a recessed light fixture 101 in accordance with another embodiment of the present disclosure. Note that the same or similar elements or layers corresponding to those of the recessed light fixture are denoted by like reference numerals. The same or similar elements or layers denoted by like reference numerals have the same meaning and will not be repeated for the sake of brevity.

The difference between the embodiment shown in FIG. 6A and the embodiment shown in FIGS. 1A-5B is that the recessed light fixture 101 only includes the first intumescent material 112A, and does not include the second intumescent material. In addition, the barrier pad 118 directly contacts the top surface 104S1 and the inner wall 104S3 of the front flange 104.

Figure 6B:
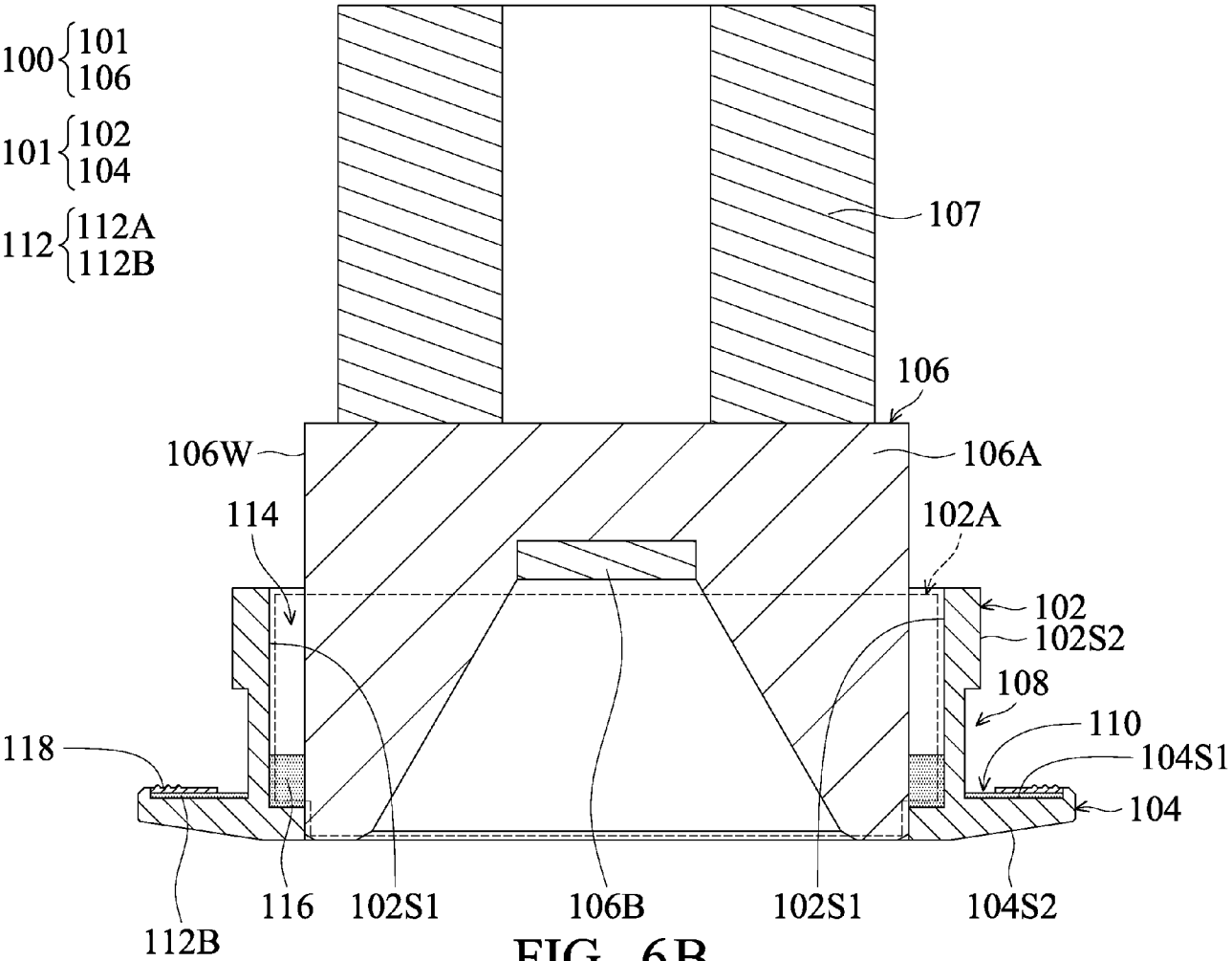
FIG. 6B is a cross-sectional view of a recessed light fixture in accordance with another embodiment of the present disclosure.

Next, referring to FIG. 6B, which is a cross-sectional view of a recessed light fixture 101 in accordance with another embodiment of the present disclosure. The difference between the embodiment shown in FIG. 6B and the embodiments shown in FIGS. 1A-6A is that the recessed light fixture 101 only includes the second intumescent material 112B, and does not include the first intumescent material 112A. In addition, the second intumescent material 112B directly contacts the first recess 108.

It should be noted that, although the top surface of the front flange is substantially perpendicular to the outer wall of the casing in the embodiments shown in FIGS. 1A-6B, those skilled in the art will appreciate that the top surface of the front flange may intersect the outer wall of the casing at an acute angle. This will be described in detail in the following description. Therefore, the exemplary embodiments set forth in FIGS. 1A-6B is merely for the purpose of illustration, and the inventive concept may be embodied in various forms without being limited to the exemplary embodiments as shown in FIGS. 1A-6B.

Figure 7:
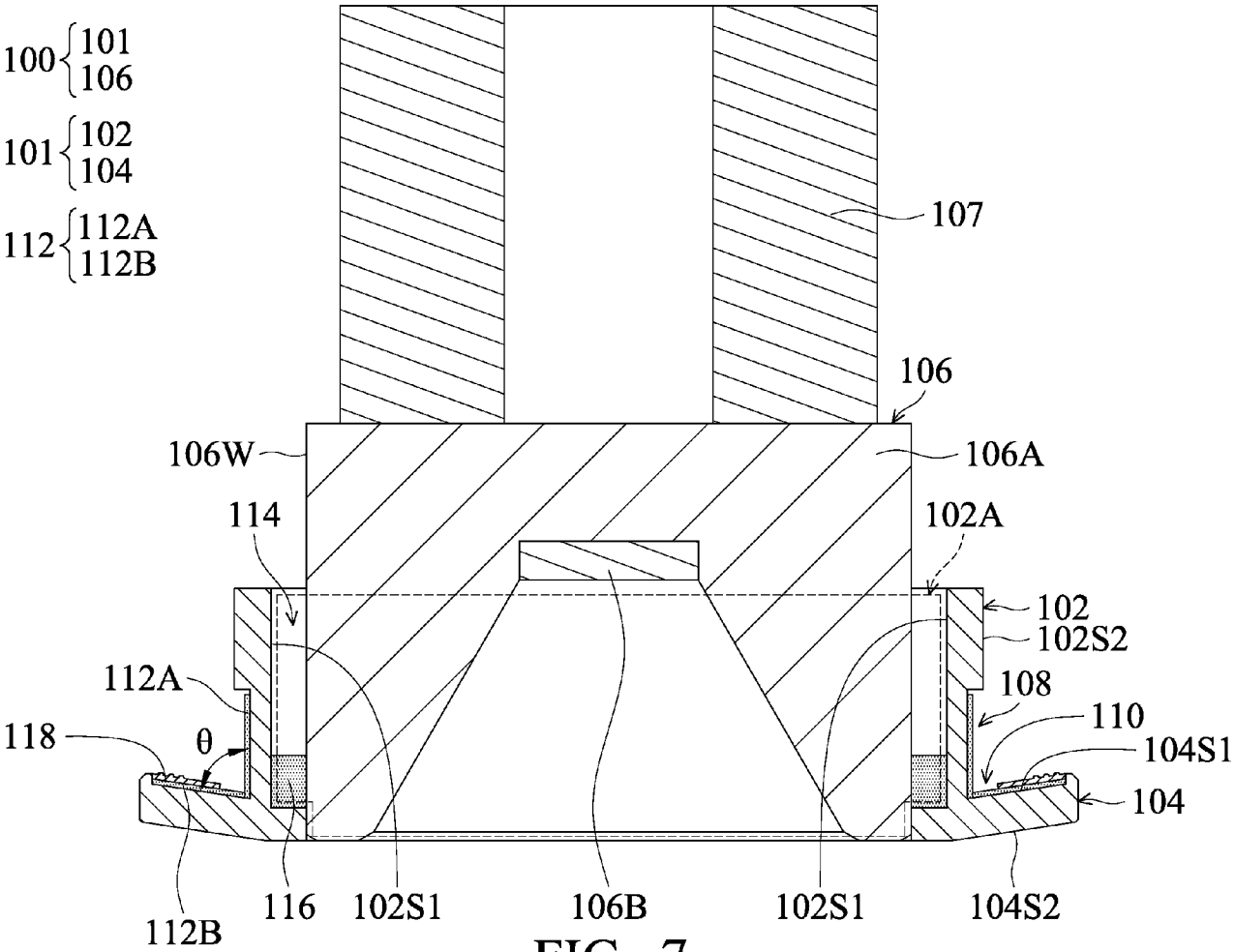
FIG. 7 is a cross-sectional view of a recessed light fixture in accordance with yet another embodiment of the present disclosure.

FIG. 7 is a cross-sectional view of a recessed light fixture 101 in accordance with another embodiment of the present disclosure. In this embodiment, the top surface 104S1 of the front flange 104 intersects the outer wall 102S2 of the casing 102 at an acute angle θ, rather than being perpendicular to the outer wall 102S2 of the casing 102 as in the embodiments of FIGS. 1A-2 and 6A-6B.

It will be appreciated that, while the examples show the casing or the recessed light fixture having a generally circular cylindrical tubular shape, this is not essential. Any form of casing or recessed light fixture may be used.

In summary, the present disclosure utilizes the intumescent material disposed in the recess to improve the fireproof ability of the recessed light fixture. In addition, the present disclosure also utilizes the barrier pad to prevent the moisture and air from passing through the gaps or irregularities between the recessed light fixture and the building. Therefore the risk of fire may be further decreased and the noise may be further reduced.

Although some embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A recessed light fixture, comprising:

a casing having an inner wall and an outer wall defining a space, wherein a first recess is disposed in the outer wall;

a front flange extending outwardly from the casing and surrounding the space, wherein the front flange has a top surface, a bottom surface, and a second recess disposed on the top surface;

an intumescent material disposed in the first recess of the outer wall and/or disposed on the top surface of the front flange; and a barrier pad disposed in the second recess.

2. The recessed light fixture as claimed in claim 1, wherein the intumescent material is disposed in the first recess and/or the second recess.

3. The recessed light fixture as claimed in claim 2, wherein the intumescent material comprises graphite-based intumescent material, silicone-based intumescent material, mastic-based intumescent material, organic-based intumescent material or water-based intumescent material.

4. The recessed light fixture as claimed in claim 2, wherein an onset temperature of the intumescent material is 100° C. or higher.

5. The recessed light fixture as claimed in claim 2, wherein a free expansion ratio of the intumescent material is 20:1 or higher.

6. The recessed light fixture as claimed in claim 2, wherein the intumescent material comprises a first intumescent material disposed in the first recess and a second intumescent material disposed in the second recess.

7. The recessed light fixture as claimed in claim 6, wherein the barrier pad is disposed over a portion of the second intumescent material and a portion of the second intumescent material is exposed.

8. The recessed light fixture as claimed in claim 7, wherein the barrier pad does not contact the first intumescent material.

9. The recessed light fixture as claimed in claim 1, wherein one side of the barrier pad directly contacts an inner wall in the second recess of the front flange.

10. The recessed light fixture as claimed in claim 1, wherein a material of the barrier pad comprises polymer or synthetic rubber.

11. The recessed light fixture as claimed in claim 1, wherein the barrier pad does not contact the intumescent material.

12. The recessed light fixture as claimed in claim 1, wherein the first recess connects with the second recess.

13. The recessed light fixture as claimed in claim 1, wherein the barrier pad comprises a plurality of cuts at an inner side of the barrier pad.

14. The recessed light fixture as claimed in claim 13, wherein the plurality of the cuts has a triangular shape, a semicircular shape, a rectangular shape or a trapezoidal shape.

15. The recessed light fixture as claimed in claim 1, wherein the barrier pad comprises at least one annular protrusion.

16. The recessed light fixture as claimed in claim 15, wherein the annular protrusion has a triangular cross-section, a semicircular cross-section, a rectangular cross-section or a trapezoidal cross-section.

17. The recessed light fixture as claimed in claim 1, wherein:

the barrier pad comprises the plurality of annular protrusions, and heights of the plurality of annular protrusions decrease from a periphery of the barrier pad to a center of the barrier pad.

18. The recessed light fixture as claimed in claim 1, wherein:

the barrier pad comprises the plurality of annular protrusions, and heights of the plurality of annular protrusions increase from a periphery of the barrier pad to a center of the barrier pad.

19. The recessed light fixture as claimed in claim 1, wherein the space of the casing is for receiving a lamp.

20. The recessed light fixture as claimed in claim 19, further comprising:

a gap between a wall of the lamp and the inner wall of the casing; and an intumescent glue partially filled in the gap.

* * * * *